United States Patent [19]

Revell

[11] Patent Number: 5,021,298

[45] Date of Patent: Jun. 4, 1991

[54] HIGH BARRIER METALLIZED FILM

[75] Inventor: Kenneth M. Revell, Thetford, England

[73] Assignee: Bowater Packaging Limited, London, England

[21] Appl. No.: 334,534

[22] Filed: Apr. 7, 1989

[30] Foreign Application Priority Data

Apr. 8, 1988 [GB] United Kingdom ..... 8808219

[51] Int. Cl.[5] ..... B32B 15/08; B32B 27/08

[52] U.S. Cl. ..... 428/458; 428/457; 428/461; 428/464

[58] Field of Search ..... 428/211, 40, 34.8, 910, 428/461, 458, 457, 464

[56] References Cited

U.S. PATENT DOCUMENTS

| | | | |
|---|---|---|---|
| 3,869,336 | 3/1975 | Sander et al. | 428/211 |
| 3,870,539 | 3/1975 | Glaser et al. | 428/40 |
| 4,396,039 | 8/1983 | Klenk et al. | 428/34.8 X |
| 4,565,733 | 1/1986 | Akao | 428/910 X |

*Primary Examiner*—Thomas J. Herbert

*Attorney, Agent, or Firm*—Watson, Cole, Grindle & Watson

[57] ABSTRACT

A packaging material suitable for packaging moisture and oxygen-sensitive materials comprises a coated and metallized plastic film having low permeability to gases, moisture and light, which includes a polyolefin or regenerated cellulose film that is coated on one or both surfaces with one or more thin but smooth layers of a thermally stable coating, other than polyvinylidene chloride, and metallized over the coated surface or surfaces.

10 Claims, 1 Drawing Sheet

HIGH BARRIER METALLIZED FILM

This invention relates to coated and metallised plastic films which are especially, but not exclusively, useful for packaging materials, particularly materials which are sensitive to oxygen and/or water vapour.

It is well known to package materials in plastic films or plastic film laminates. Where the materials are sensitive to oxygen and/or water vapour (e.g. materials such as certain foodstuffs, beverages, chemicals, pharmaceuticals, seeds, electrical components, etc.), a plastic packaging material is chosen which will provide a barrier against ingress of oxygen and/or water vapour. It is also well known to package certain foodstuffs in an atmosphere of gas contained within a plastic material chosen for its low permeability to that gas (controlled atmosphere packaging).

One such plastic film which has the property of low permeability to oxygen, other gases and water vapour is metallised poly (ethylene glycol) terephthalate (hereafter PET), a single web of which may typically provide an oxygen barrier of about 1 cc/meter$^2$/24 hours (at 23° C., 0% RH) and a moisture barrier of about 1 gram/meter$^2$/24 hours (at 38° C., 90% RH). Metallised PET can be further laminated to a heat sealable film such as a polyolefin (e.g. polyethylene or polypropylene) to produce a material suitable for packaging oxygen or moisture-sensitive products, but gas and moisture barrier are not significantly improved by this lamination.

By laminating metallised PET to a further web of metallised film, either another ply of metallised PET or another metallised thermoplastic polymer film, further reductions in permeability can be achieved. U.K. patent specification no. 2103999A describes such a packaging material comprising two layers of metallised thermoplastic polymer film, at least one of whIch is metallised PET.

For some applications it is desirable to decorate the package with, for example, print, and for reasons of security and integrity this print is often preferably sandwiched within the laminate. This can be achieved by printing the PET, and metallising over the print before further conversion. This procedure normally gives a material with a greater permeability than that of the film metallised directly. By careful choice of inks it is possible to keep this deterioration in barrier within acceptable limits, but no instances have been disclosed of use of this technique to improve barrier.

Other plastic films which have the property of low permeability to moisture (but not oxygen) are metallised polyolefins, such as metallised oriented polypropylene (hereafter OPP) or metallised polyethylene (hereafter PE), single webs of which may typically provide a moisture barrier of about 1 gram/meter$^2$/24 hours (at 38° C., 90% RH), and laminates of such metallised polyolefin films to unmetallised films, suitable for packaging of moisture sensitive materials, are described in U.K. patent specification no. 1566925. Gas and moisture barrier are not significantly improved over those of the single web metallised film by this lamination, unless the clear web itself or the adhesive has good barrier properties. For some applications, it is desirable to decorate the package with, for example, print, and the print is often preferably sandwiched within the laminate. This is normally achieved by printing the clear web and laminating to the metallised polyolefin web. Gas and moisture barrier are not significantly improved over that of the single web metallised film unless the clear web itself or the ink or the adhesive has good barrier properties. Sandwiched decoration could also be achieved by printing the clear polyolefin web and metallising over the print, and then laminating to another clear polyolefin web, but no benefits are disclosed for this procedure and it is not used commercially, the former process described above being preferred.

By laminating a metallised polyolefin film to a further web of a metallised polyolefin film, further reductions in permeability can be achieved and a material with both good moisture barrier and good oxygen barrier produced. European patent specification no. 154428 describes such laminates.

Polypropylene films with a coating on one or both sides and metallised on one or more of the coated surfaces are also known and commercially available. If the noted coating is of a thermoplastic polymer resin with no particular barrier properties, such as an acrylic resin, oxygen permeability of the unmetallised coated film is high (typically 500–1000 cc/meter$^2$/24 hours at 23° C., 0% RH) and oxygen permeability after metallisation is also correspondingly high (greater than 10 cc/meter$^2$/24 hours at 23° C., 0% RH). If the noted coating is of a thermoplastic polymer resin with good barrier properties, such as a polyvinylidene chloride resin, oxygen permeability of the coated film is significantly reduced (typically 25 cc/meter$^2$/24 hours at 23° C., 0% RH) and oxygen permeability after metallisation is correspondingly low (typically less than 5 cc/meter$^2$/24 hours at 23° C., 0% RH). One such commercially available polyvinylidene chloride coated and metallised OPP film is Mobil MB778 which typically bas an oxygen permeability of about 1 cc/meter$^2$/24 hours at 23° C., 0% RH. Such films are widely used for packaging either in single web form or laminated to another unmetallised web. For applications where it is desirable to decorate the package with, for example, print, and to sandwich said print within a laminate, the unmetallised web is normally printed and laminated to the metallised coated polypropylene web. No benefits are disclosed for printing a coated polypropylene web, metallising over the print, and laminating to another clear web, and it is not used commercially, the former process described above being preferred.

Another film with moderate barrier to oxygen and moisture is regenerated cellulose film coated on both sides with polyvinylidene chloride. One commercially available example of such a PVdC coated regenerated cellulose film is MXXT/A, produced by British Cellophane Limited, which has an oxygen permeability of typically 5–7 cc/m$^2$/24 hours (at 23° C., 0% RH) and an MVTR of typically 5–6 g/m$^2$/24 hours (at 38° C., 90% RH). This can be metallised, but the metallised product (one commercially available example of which is Cello M, produced by British Cellophane Limited) does not have significantly better oxygen or moisture barrier than the base film (typically an oxygen permeability of 4–5 cc/m$^2$/24 hours (at 23° C., 0% RH) and an MVTR of 4–5 g/m$^2$/24 hours (at 38° C., 90% RH). By laminating such a metallised polyvinylidene chloride coated regenerated cellulose film to a further web of metallised film, such as another metallised polyvinylidene chloride coated regenerated cellulose film, or a metallised polyolefin film or a metallised polyester film significant reductions in permeability can be achieved and a material with both good oxygen barrier and good moisture barrier produced. Such laminates are described in, for example, European patent specification number 154428.

Whilst laminates as described above of metallised polyolefin films to other metallised polyolefin films or metallised cellophane films or metallised polyester films are highly advantageous in packaging moisture and/or oxygen sensitive materials, because of their excellent barrier properties, they also have some disadvantages, for example:

(a) Cost. Relative to many other thermoplastic films and laminates used in packaging, these laminates are expensive, so for some end uses their use is precluded on cost grounds.

(b) If it is desired to decorate the pack with a sandwiched print, this can often only be achieved by laminating on a further ply of reverse printed film, which both increases costs and reduces flexibility of the laminate.

Metallised polyvinylidene chloride coated OPP films are generally less expensive than laminates but their cost of manufacture and suitability for some applications can be limited by the facts that:

(a) they cannot be readily recycled during manufacture, because the polyvinylidene chloride coating pyrolyses, contaminating the polypropylene and producing an odorous film containing black particles of degraded material.

(b) in some countries, waste disposal legislation precludes the use of polyvinylidene chloride coated films because of the acid gases they produce when incinerated.

SUMMARY OF THE INVENTION

We have now found that, in contrast to prior teachings, it is not necessary to combine together two metallised films as a laminate or to coat a film with a barrier lacquer such as polyvinylidene chloride prior to metallisation, in order to achieve very high barrier properties. Rather, we have found that by applying to the surface of a polyolefin or regenerated cellulose film a thin but smooth layer of a plastic coating with relatively little inherent barrier, of the type described below, and metallising over the coating, very high barrier can be achieved, generally at least a factor of ten and up to a factor of more than one thousand times better than the barrier of the metallised uncoated film. The smoothness of the coating is crucial to the invention.

In accordance with the present invention, there is provided a flexible plastic film A, coated on one or both faces with a thin coating B to give a smooth finish, and metallised on one or both of the coated surfaces. The invention also provides a process for packaging a material, in which process a coated and metallised film as defined above, or a laminate of such a film to other films, is used. Such films and laminates are especially but not exclusively useful for packaging of materials sensitive to oxygen and/or water vapour or for controlled atmosphere packaging of foodstuffs.

Film A is preferably a polyolefine or regenerated cellulose film of any thickness which can be metallised, including composites or coextrusions of the above materials, or variants coated with other plastics, whether or not these other plastics have barrier properties. The film should preferably contain a low level of migratory additives such as slip additives in the surface to be metallised, since these will migrate to the surface, and although not substantially affecting barrier properties, could disrupt adhesion of the metal layer.

Coating B can be any plastic resin coating other than polyvinylidene chloride, with a thickness of less than 10 microns, which is not required to have any inherent barrier properties, but which will adhere to and provide cover for the film surface, will give a smooth surface for metallisation and which will not significantly degrade, crack, craze or delaminate on metallisation. Such smoothness and integrity are most conveniently assessed after metallisation by analytical techniques such as scanning electron microscopy (SEM) at a magnification of about 15,000–50,000 times. Such coatings include water based, solvent based or solventless thermoplastic lacquers or inks based on resins such as polyester, nitrocellulose, acrylic or vinyl, hot melt coatings, extrusion coated thermoplastic resins and curing resin systems (cured by chemical cross-linking, ultra violet or electron beam irradiation or any other system). Multiple layers of coatings, whether of the same resin or different resins, are included. We prefer to use solvent-based polyester or nitrocellulose lacquers with a coating thickness of between 0.5 and 2 microns. The coating can be applied by any suitable coating technique, either during manufacture of the film or in a subsequent process, provided this technique gives a smooth surface for metallisation. We prefer to use gravure coating. The thickness of the metal layer should be such that at its minimum thickness it provides a largely continuous metal layer and at its maximum thickness it still has adequate adhesion to the substrate. Thickness of thin vacuum deposited metal layers is normally, and most conveniently, quoted in terms of their light transmission or optical density. An optical density in the range 1.0–4.0 is preferred with the range 1.8–3.5 being especially preferred. Any metal which on vacuum deposition gives a barrier layer is satisfactory, with aluminium being preferred.

In order that the invention may be more fully understood, the following Examples are given by way of illustration only.

EXAMPLE 1

2000 meters of a 30 micron coextruded OPP film (commercially available as propafilm MVG from ICI Films PLC) were coated on the corona treated surface with 1.5 grams/meter$^2$ of a proprietary solvent based lacquer based on a polyester resin and dried to remove solvent. A further 2000 meters of film were left uncoated. Prior to coating, the OPP film had an oxygen permeability of greater than 1000 cc/meter$^2$/24 hours at 23° C., 0% RH. After coating oxygen permeability was still greater than 1000 cc/meter$^2$/24 hours at 23° C., 0% RH. The 4000 meter composite reel of coated and uncoated film was metallised with aluminium on the coated/treated surface to an optical density of 2.4. Oxygen permeability of the coated part of the film after metallisation was 0.8 cc/meter$^2$/24 hours (at 23° C., 0% RH) and MVTR 0.13 gram/meter$^2$/24 hours (at 38° C., 90% RH). The uncoated control had an oxygen permeability of 90 cc/meter$^2$/24 hours (at 23° C., 0% RH) and MVTR of 1.4 gram/meter$^2$/24 hours (at 38° C., 90% RH). Examination of the metallised coated surface by scanning electron microscopy at magnifications of 17,0000 and 50,000 showed a relatively smooth appearance with fine grain topography and few macroscopic defects such as scratches or pits. In contrast, the metallised uncoated surface was rough with many defects in the metallisation. Comparison of the size of the aluminium crystallites on the coated and uncoated metallised films by transmission electron microscopy showed that both had a crystallite diameter of 300–350 Angstroms, i.e. not significantly different.

EXAMPLE 2

Example 1 was repeated using 40 micron low slip low density polyethylene film (commercially available as Polyane CT from Prosyn Polyane). Half of the reel was coated on its corona treated side with 1.5 grams/meter$^2$ of the lacquer described in Example 1, and dried. The composite reel was metallised to an optical density of 2.3. Oxygen permeability of the coated and metallised film was 1.1 cc/meter$^2$/24 hours at 23° C., 0% RH compared with 95 cc/meter$^2$/24 hours at 23° C., 0% RH for the uncoated and metallised control. MVTR's (at 38° C., 90% RH) for the example and control were respectively 0.17 and 1.1 gram/meter$^2$/24 hours.

EXAMPLE 3

Example 1 was repeated using regenerated cellulose film without a polyvinylidene chloride coating. This was coated on both sides with a proprietary solvent based lacquer based on a polyester resin and dried to remove the solvent. Dry coat weight was 1.4 g/m$^2$ on each surface. One coated surface of the film was metallised to an optical density of 2.3. Oxygen permeability of the resultant film was less than 0.1 cc/m$^2$/24 hours at 23° C., 0% RH. MVTR (at 38° C., 90% RH), measured with the metallised surface facing the detector to minimise outgassing of moisture from the cellulose core) was less than 1.0 g/m$^2$/24 hours (unstable reading).

EXAMPLE 4

Example 1 was repeated using 365 gauge PVdC coated regenerated cellulose film (commercially available as Cello MXXT/A from British Cellophane Limited). Coat weight was 1.5 grams/meter$^2$ and optical density 2.3. Oxygen permeability of the coated and metallised films was 0.02 cc/meter$^2$/24 hours compared with 4.8 cc/meter$^2$/24 hours for the control. MVTR (at 38° C., 90% RH) for the example and control were respectively 1.0 (unstable reading due to moisture outgassing from the regenerated cellulose core) and 4.5 gram/meter$^2$/24 hours.

EXAMPLE 5

Example 1 was repeated using an acrylic coated 21 micron OPP film (commercially available as MB666 from Mobil Plastics, and coated on both sides with an acrylic lacquer by the supplier). This was recoated on one of the acrylic surfaces with 1.5 gram/meter$^2$ of a proprietary polyester based lacquer as described above and metallised to an optical density of 2.2. Oxygen permeability of the example film was 0.8 cc/meter$^2$/24 hours compared with 25 cc/meter$^2$/24 hours for the control. MVTR's (at 38° C., 90% RH) for the example and control were respectively 0.4 and 2.0 gram/meter$^2$/24 hours.

EXAMPLE 6

Example 1 was repeated using an acrylic/PVdC coated 21 micron OPP film (commercially available as MB777 from Mobil Plastics and coated on one side with an acrylic lacquer and on the other with a PVdC lacquer by the supplier). This film was recoated with a proprietary polyester based lacquer on the acrylic coated side and metallised. Coat weight was 1.5 grams/meter$^2$ and optical density 2.3. Oxygen permeability of the example film was 0.2 cc/meter$^2$/24 hours compared with 15 cc/meter$^2$/24 hours for the control. MVTR's (at 38° C., 90% RH) for the example and control were respectively 0.2 and 1.0 gram/meter$^2$/24 hours.

EXAMPLE 7

Example 2 was repeated using- a proprietary solvent based lacquer based on a nitro cellulose resin. Coat weight was 1.6 gram/meter$^2$. Oxygen permeability of the base film before coating was greater than 3000 cc/meter$^2$/24 hours at 23° C., 0% RH. After coating, oxygen permeability was still greater than 3000 cc/meter$^2$/24 hours at 23° C., 0% RH. The composite reel was metallised to an optical density of 2.3. Oxygen permeability of the coated and metallised film was 2.2 cc/meter$^2$/24 hours at 23° C., 0% RH compared with 100 cc/meter$^2$/24 hours at 23° C., 0% RH for the uncoated and metallised control. MVTR's (at 38° C., 90% RH) for the example and control were respectively 0.35 and 1.2 gram/meter$^2$/24 hours.

EXAMPLE 8

Example 7 was repeated using 365 gauge PVdC coated regenerated cellulose film as the substrate. Coat weight was 1.6 gram/meter$^2$. Oxygen permeability of the base film before coating was 6.9 cc/meter$^2$/24 hours at 23° C., 0% RH. After coating, oxygen permeability was 6.7 cc/meter$^2$/24 hours at 23° C., 0% RH. MVTR's (at 38° C., 90% RH) before and after coating were respectively 6.0 and 5.8 grams/meter$^2$/24 hours. The composite reel was metallised to an optical density of 2.2. Oxygen permeability of the coated and metallised film was 0.03 cc/meter$^2$/24 hours at 23° C., 0% RH compared with 4.4 cc/meter$^2$/24 hours at 23° C., 0% RH for the control. MVTR's (at 38° C., 90% RH) for the example and control were respectively 1.3 (unstable reading due to moisture outgassing from the cellophane core) and 4.5 gram/meter$^2$/24 hours.

EXAMPLE 9

Example 7 was repeated using 21 micron Mobil MB777 (as example 5), coating on the acrylic surface. Nitro cellulose coat weight was 1.6 grams/meter$^2$ and optical density 2.3. Oxygen permeability of the example (at 23° C., 0% RH) was 0.4 cc/meter$^2$/24 hours compared with 14 cc/meter$^2$/24 hours for the controls. MVTR's (at 38° C., 90% RH) were respectively 0.4 and 1.1 gram/meter$^2$/24 hours.

In order to illustrate the present invention the accompanying drawings are given in which:

BRIEF DESCRIPTION OF THE DRAWINGS

Referring to the drawings, FIG. 1 shows a polyolefin or regenerated cellulose film 1 to one surface of which has been applied the thin smooth coating 2. The coating 2 has been metallised 3.

FIG. 2 is similar to FIG. 1 (like numerals indicate like parts) but here both surfaces of the film 1 have been coated (2,2') and the coatings both metallised (3,3').

FIG. 3 is essentially the same as FIG. 1 (like numerals indicate like parts) except that the coating layer 2 of FIG. 1 is made up of two applications of coating material in FIG. 3, the two applications giving sublayers 2A,2B. The outer surface of layer 2B is the smooth surface upon which the metal layer 3 is formed.

Figure 1:
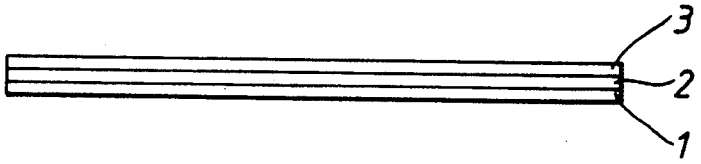
FIG. 1 is a schematic sectional view of a first embodiment of film of the invention.
Figure 2:
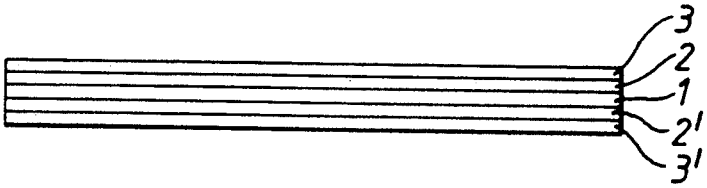
FIG. 2 is a schematic sectional view of a second embodiment of film of the invention.
Figure 3:
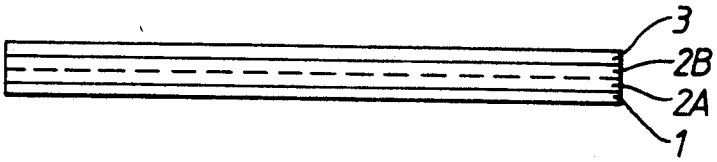
FIG. 3 is a schematic sectional view of a third embodiment of film of the invention.

I claim:

1. A coated and vacuum-metallised plastic film having low permeability to gases, moisture and light, which comprises a film substrate selected from the group consisting of polyolefin and regenerated cellulose, which film is coated on at least one surface with at least one thin but smooth layer of a thermally stable plastic resin coating material other than polyvinylidene chloride, and a vacuum-metallised layer over the coated surface, said vacuum-metallised layer having an optical density of 1.0 to 4.0.

2. A regenerated cellulose film according to claim 1, having an oxygen permeability of less than 1 cc/m$^2$/24 hours (at 23° C., 0% RH).

3. A plastic film according to claim 1, wherein the substrate is regenerated cellulose.

4. A plastic film according to claim 1, wherein the coating is based on a polyester resin.

5. A plastic film according to claim 1, wherein the coating is based on a nitrocellulose resin.

6. A plastic film according to claim 1, wherein the substrate is a polyolefin selected from polyethylene and polypropylene.

7. A plastic film according to claim 6, having an oxygen permeability of less than 5 cc/m$^2$/24 hours (at 23° C., 0% RH).

8. A material useful for packaging substances which are moisture- and oxygen-sensitive, which material comprises a flexible plastic film substrate selected from the group consisting of polyolefins and regenerated celluloses, at least one surface of said substrate having thereon at least one thermally stable plastic resin coating selected from solvent-based polyester and nitrocellulose lacquer coatings, the total coating thickness on each said substrate surface not exceeding 10 microns and the coating having a smooth outer surface; and a vaccum-metallized layer of metal on said smooth outer surface, the thickness of the metal layer being in the range 1.0 to 4.0 optical density.

9. A packaging material according to claim 8, wherein the substrate is polyethylene or polypropylene film.

10. A coated and vacuum-metallised plastic film having a low permeability to gases, moisture and light, which comprises (a) a film substrate made of regenerated cellulose, said film substrate having opposite surfaces, (b) at least thin layer of a nitrocelluse resin on at least one of said opposite surfaces of said film substrate, and (c) a vacuum-metallised layer over each thin layer.

* * * * *